US005511475A

United States Patent [19]

Pfizenmaier

[11] Patent Number: 5,511,475

[45] Date of Patent: Apr. 30, 1996

[54] PRINTING UNIT FOR A ROTARY OFFSET PRINTING PRESS

[75] Inventor: Wolfgang Pfizenmaier, Neckargemünd, Germany

[73] Assignee: Heidelberger Druckmaschinen AG, Heidelberg, Germany

[21] Appl. No.: 497,856

[22] Filed: Jul. 3, 1995

[30] Foreign Application Priority Data

Jul. 2, 1994 [DE] Germany ..... 44 23 286.1

[51] Int. Cl.[6] ..... B41F 31/00

[52] U.S. Cl. ..... 101/349; 101/351

[58] Field of Search ..... 101/216, 347, 101/348, 349, 350, 351, 352, 362

[56] References Cited

U.S. PATENT DOCUMENTS

| | | | |
|---|---|---|---|
| 2,958,275 | 11/1960 | Büttner | 101/351 |
| 3,304,863 | 2/1967 | Jurný | 101/351 |
| 3,610,149 | 10/1971 | Jurný | 101/352 |
| 4,397,237 | 9/1983 | Mavosch | 101/247 |
| 4,429,631 | 2/1984 | Commers . | |
| 4,711,174 | 12/1987 | Beisel | 101/362 |
| 4,882,991 | 11/1989 | Simeth | 101/350 |
| 5,081,928 | 1/1992 | Harrison | 101/351 |
| 5,345,865 | 9/1994 | Kemp . | |
| 5,388,514 | 2/1995 | Eltner | 101/352 |

FOREIGN PATENT DOCUMENTS

| | | |
|---|---|---|
| 1187245 | 2/1965 | Germany . |
| 1808909 | 3/1978 | Germany . |

*Primary Examiner*—Eugene H. Eickholt

*Attorney, Agent, or Firm*—Herbert L. Lerner; Laurence A. Greenberg

[57] ABSTRACT

Printing unit for a rotary offset printing press having a plate cylinder bearing a printing plate suitable for offset-printing operation free of dampening solution, and an inking unit with a multiplicity of inking rollers for inking the printing plate during operation with a printing ink suitable for offset-printing operation free of dampening solution includes an auxiliary roller bringable, independently of the inking rollers, into engagement with and out of engagement from the printing plate, the auxiliary roller, at least in a first operating position thereof wherein it is in engagement with the printing plate, being rotatable opposite to the direction of rotation of the plate cylinder at a circumferential speed different from the circumferential speed of the plate cylinder and, in a second operating position thereof wherein it is out of engagement with the printing plate, forming a component or constituent part of the inking unit.

6 Claims, 3 Drawing Sheets

PRINTING UNIT FOR A ROTARY OFFSET PRINTING PRESS

BACKGROUND OF THE INVENTION

1. Field of the Invention

The invention relates to a printing unit for a rotary offset printing press having a plate cylinder bearing a printing plate suitable for offset-printing operation free of dampening solution, and an inking unit with a multiplicity of inking rollers, is provided for inking the printing plate during operation with a printing ink suitable for offset-printing operation free of dampening solution.

In such a printing unit, it is incumbent upon the plate cylinder to transfer, by means of the inking unit, printing ink which has been applied to the plate cylinder to an offset cylinder cooperating therewith and provided, in turn, for inking up stock or printing material with ink that which been accepted from the plate cylinder. In the process of inking up the printing ink, it has been found to be disadvantageous that particles with low adhesion to the printing material, such as paper fibers, for example, in cases wherein paper is used as the printing material, are transferred to the offset cylinder and to the printing plate to which they may become attached.

In contrast with an offset printing unit which employs dampening solution and in which, in particular, a difference in circumferential speeds of the plate cylinder, on the one hand, and a dampening roller contacting the plate cylinder, on the other hand, is provided, the danger arises, when performing offset printing free of dampening solution in a printing unit of the aforementioned type, that lint particles may accumulate on the printing plate, with the consequent formation of a correspondingly defective printed image on the printing material or stock.

An offset printing unit employing dampening solution has become known heretofore, for example, from the published German Patent Document DE 18 08 909 C3, wherein, in order to remove impurities from the plate cylinder, at least one of the applicator rollers of the dampening unit or the inking unit has a circumferential speed that is different from that of the plate cylinder. The resultant mode of operation, however, is considered unsuitable for use in a printing unit of the aforementioned type. The basis therefor lies in the nature of a printing plate suitable for offset printing free of dampening solution. Such a printing plate, namely, has a non-metallic surface coating with a far lower resistance to wear than that of a printing plate which has been formed for offset printing using dampening solution.

SUMMARY OF THE INVENTION

It is accordingly an object of the invention to provide a printing unit for a rotary offset printing press with which it is possible to prevent defects in the printed image formed on the printing material as a result of impurities or contamination in the printing plate, without having to take into account any impermissible wear of the image-forming surface of the printing plate.

With the foregoing and other objects in view, there is provided, in accordance with the invention, a printing unit for a rotary offset printing press having a plate cylinder bearing a printing plate suitable for offset-printing operation free of dampening solution, and an inking unit with a multiplicity of inking rollers for inking the printing plate during operation with a printing ink suitable for offset-printing operation free of dampening solution, comprising an auxiliary roller bringable, independently of the inking rollers, into engagement with and out of engagement from the printing plate, the auxiliary roller, at least in a first operating position thereof wherein it is in engagement with the printing plate, being rotatable opposite to the direction of rotation of the plate cylinder at a circumferential speed different from the circumferential speed of the plate cylinder and, in a second operating position thereof wherein it is out of engagement with the printing plate, forming a component or constituent part of the inking unit.

In accordance with another feature of the invention, the auxiliary roller, as viewed in the direction of rotation of the plate cylinder, is disposed forward of the inking unit.

In accordance with a further feature of the invention, the printing unit includes a gearwheel rotating uniformly during operation, and a toothed section connected to the auxiliary roller and meshing with the gearwheel for driving the auxiliary roller.

In accordance with an added feature of the invention, the printing unit includes a transmission device having a first transmission pulley rotating uniformly during operation, a second transmission pulley for driving the auxiliary roller, an endless transmission member looped around the first and the second transmission pulleys, a tensioning pulley for applying tension to the transmission member, and a spring device for exerting pressure upon the tensioning pulley for tensioning the transmission member.

In accordance with an additional feature of the invention, the printing unit includes a driving roller rotating uniformly during operation, the driving roller, at least when the auxiliary roller is in the first operating position thereof, being in engagement with the auxiliary roller for driving the auxiliary roller by means of frictional contact.

In accordance with a concomitant feature of the invention, the auxiliary roller, in a third operating position thereof, both is in contact with the printing plate and, by engagement with a roller of the inking unit, forms a constituent part or component of the inking unit.

According to the invention, therefore, an auxiliary roller is provided which is adapted, independently of the inking rollers, to be brought into engagement with and out of engagement from the printing plate, the auxiliary roller rotating, at least in a first operating position thereof wherein it is in engagement with the printing plate, opposite to the direction of rotation of the plate cylinder at a circumferential speed different from the circumferential speed of the plate cylinder and, in a second operating position thereof, out of engagement with the printing plate, forming a constituent part or component of the inking unit.

A printing unit according to the invention may be operated in such a manner that, as and when required or at specified intervals, the auxiliary roller is brought into the first operating position thereof for the duration of a specified number of revolutions of the plate cylinder, after having previously been in the second operating position and, consequently, having been covered with a partial quantity of the printing ink supplied from the inking unit. As a consequence thereof and due to the existing difference in circumferential speed between the plate cylinder, on the one hand, and the auxiliary roller, on the other hand, the auxiliary roller, when in the first operating position thereof, assumes the function of an only briefly used blade roller with an extremely soft cleaning coating in the form of an ink jacket surrounding the auxiliary roller and consisting of the printing ink accepted from the inking unit.

In an advantageous embodiment of the invention, the auxiliary roller, as viewed in the direction of rotation of the plate cylinder, is positioned in front of the inking unit. The auxiliary roller, actuating means provided for moving the auxiliary roller into the respective first and second operating positions thereof, as well as driving means required for operating the auxiliary roller at the circumferential speed provided for in the first operating position of the auxiliary roller, can all be accommodated in essence in the same installation space wherein, in the case of a rotary offset printing press employing dampening solution, the requisite dampening unit is conventionally disposed. There thus exist, in particular, favorable conditions for a possibly advisable conversion of a rotary offset printing press employing dampening solution to a rotary offset printing press which does not employ dampening solution during the printing process.

In order to provide the auxiliary roller, in the first operating position thereof wherein it is in engagement with the printing plate, with a circumferential speed that is different from that of the plate cylinder, an embodiment of the invention has a gearwheel rotating uniformly during operation, and a toothed section meshing with the gearwheel and driving the auxiliary roller. The aforementioned gearwheel may advantageously have a drive connection to a drive unit for driving the entire printing unit.

An alternative to this embodiment has a transmission device with a first transmission pulley rotating uniformly during operation, a second transmission pulley driving the auxiliary roller, an endless transmission member looped around the first and the second transmission pulleys, a tensioning pulley tensioning the transmission members and a spring device exerting pressure on the tensioning pulley for the purpose of tensioning the transmission member. The aforementioned first transmission pulley may advantageously be driven by means of a controllable motor. Consequently, the auxiliary roller, in the second operating position thereof, may be provided with a circumferential speed which, as required, is the same as or differs from the circumferential speed with which it is provided when it is in the first operating position thereof.

A further alternative construction of the printing unit according to the invention includes a driving roller rotating uniformly during operation and, at least when the auxiliary roller is in the operating position thereof, driving the auxiliary roller by means of frictional contact.

A further embodiment of the invention provides for the auxiliary roller, in a third operating position thereof, both to be in contact with the printing plate and also to form, through appropriate roller contact, a constituent part or component of the inking unit.

Other features which are considered as characteristic for the invention are set forth in the appended claims.

Although the invention is illustrated and described herein as embodied in a printing unit for a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
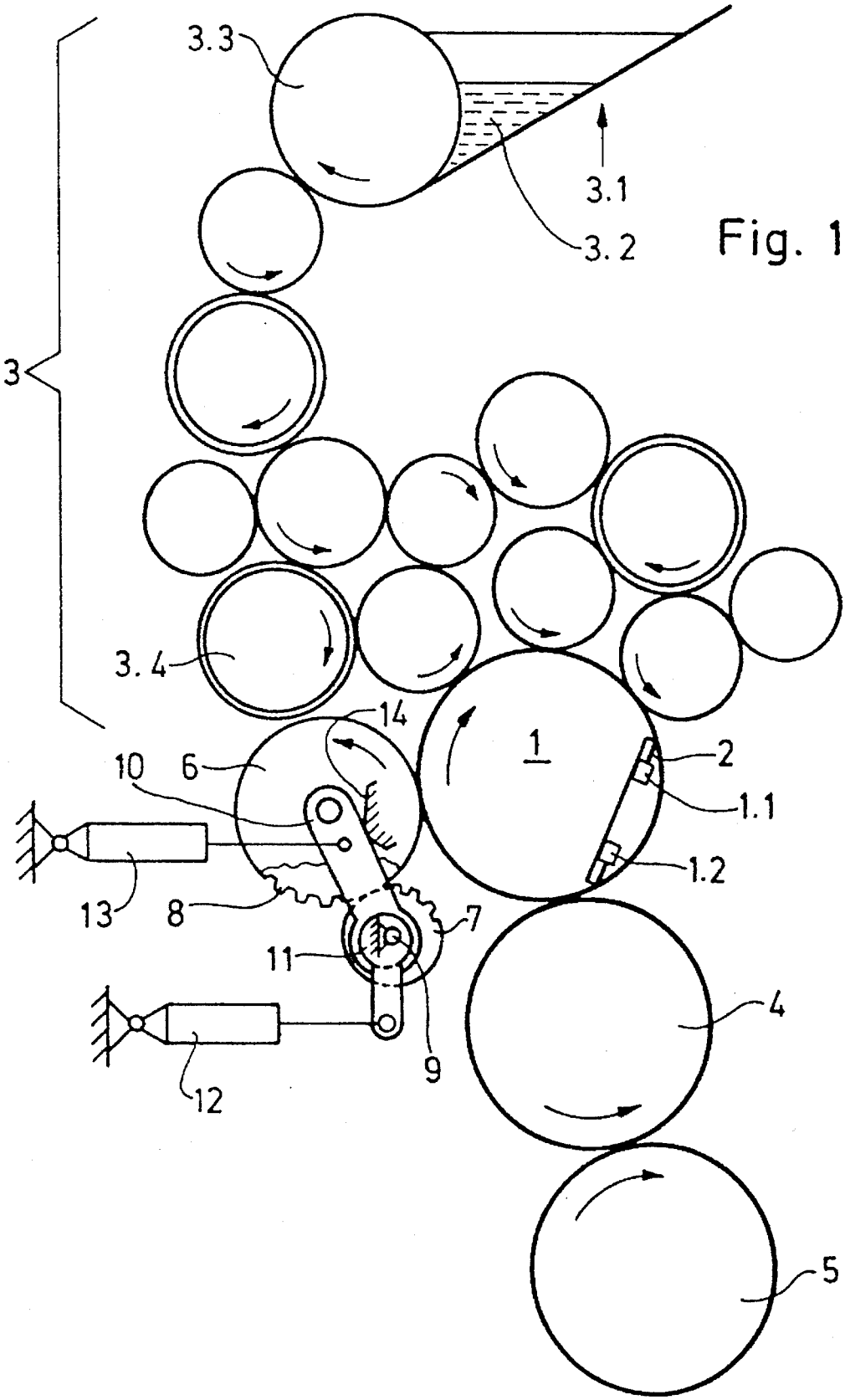
FIG. 1 is a diagrammatic side elevational view of a printing unit according to the invention having an auxiliary roller in a first operating position thereof, and a first embodiment of a driving and actuating mechanism for the auxiliary roller.

Referring now to the drawings and, first, to FIG. 1, there is shown therein a printing unit according to the invention for a rotary offset printing press. The printing unit has a plate cylinder 1 which carries a printing plate 2 suitable for offset printing free of dampening solution, and an inking unit identified as a whole by reference numeral 3, the inking unit 3 being formed of a multiplicity of inking rollers and serving for inking the printing plate 2 with a printing ink suitable for offset printing free of dampening solution. For this purpose, an ink duct 3.1, represented only diagrammatically in FIG. 1, is provided with a suitable ink supply 3.2 from which the aforementioned printing ink, starting from a duct roller 3.3 associated with the aforementioned multiplicity of inking rollers, is transferred by means of the inking rollers to the printing plate 2.

In the relatively simplified representation of FIG. 1, a leading and a trailing section of the printing plate 2 are clearly shown, which terminate in respective printing-plate clamping devices 1.1 and 1.2 of the plate cylinder 1. The printing plate 2 thus clamped onto the plate cylinder 1 cooperates in a conventional offset printing manner with an offset cylinder 4 which, in conjunction with an impression cylinder 5, forms a printing nip in which, finally, ink applied from the printing plate 2 to the offset cylinder 4 is transferred to non-illustrated stock or printing material.

An auxiliary roller 6 provided in accordance with the invention is shown in FIG. 1 in a first operating position thereof, wherein it is in engagement with the printing plate 2. The auxiliary roller 6, in a second operating position thereof, is not in contact with the printing plate 2 but, instead, for the embodiment shown, has been brought into contact with an inking roller 3.4 of the aforementioned multiplicity of inking rollers, with the result that, in the second operating position, the auxiliary roller 6 forms a constituent part or component of the inking unit 3.

In the second operating position, after a condition of equilibrium has been attained, an ink coating of specific film thickness is formed on the outer cylindrical surface of the auxiliary roller 6, by means of which the aforedescribed doctoring or wiping of the printing plate 2 is accomplished in the first operating position. The requisite rotational motion of the auxiliary roller 6 in a direction opposite to the direction of rotation of the plate cylinder 1 and at a circumferential speed different from that of the plate cylinder 1 is imparted to the auxiliary roller 6, in the embodiment illustrated in FIG. 1, by means of a gearwheel 7 which rotates steadily during operation. The gearwheel 7, both in the first as well as in the second operating position of the auxiliary roller 6, meshes with a toothed section 8 which is disposed concentrically with the auxiliary roller 6 and connected thereto so as to be fixed against relative rotation therewith. In the embodiment of FIG. 1, the gearwheel 7 is connected, through the intermediary of non-illustrated suitable transmission means, to a likewise non-illustrated drive unit for driving the entire printing unit, and executes, during operation, a uniform rotational motion with respect to a locally fixed rotational axis 9. The circumferential speed of the auxiliary roller 6 provided in accordance with the invention results from a suitable selection of the rotational speed of the gearwheel 7 and of the transmission ratio between the gearwheel 7 and the toothed section 8. Furthermore, in this embodiment, the auxiliary roller 6 is moved from the first operating position thereof into the second operating position thereof and vice versa through a suitable movement of a pair of levers 10 holding the auxiliary roller 6. For this purpose, an eccentric bushing 11 swivellable about the rotational axis 9 is rotatably inserted into a respective lever of the lever pair 10, and an actuating member 12 articulatedly connected to the eccentric bushing 11 is provided for swivelling the eccentric bushing 11 about the rotational axis 9 in a first direction of rotation and in a second direction of rotation opposite to the first direction. In each respective operating position and during the movement of the auxiliary roller 6, the lever pair formed of the respective levers 10 is, moreover, stabilized with respect to the respective position of the lever pair by means of an actuator device 13 articulatedly connected to the lever pair. Under the action of the actuator device 13, the lever pair is braced against stop means 14 which, in the first operating position of the auxiliary roller 6, determine the extent of engagement of the auxiliary roller 6 against the printing plate 2. For this purpose, it is advantageous for the stop means 14 to be adjustable; for reasons of simplification, however, conventional adjusting means appropriate for this purpose are not shown in FIG. 1.

By means of the foregoing actuator device or actuating mechanism 13, the auxiliary roller 6 is moved out of the first operating position thereof shown in FIG. 1 and into the second operating position thereof, accompanied by a swivelling of the eccentric bushing 11 in a clockwise direction, the lever pair thereby sliding in essence along the longitudinal extension of the levers 10 on the stop means 14 and, consequently, the contact between the auxiliary roller 6 and the printing plate 2 being broken and contact between the auxiliary roller 6 and the inking roller 3.4 being established.

The auxiliary roller 6 is particularly disposed also in such a manner that the distance which it travels between the two operating positions thereof is so short that, even in the second operating position, the toothed section 8 concentric with the auxiliary roller 6 does not disengage from the teeth of the gearwheel 7. In this case, therefore, also when the auxiliary roller 6 is in the second operating position thereof, there is a difference between the circumferential speed of the auxiliary roller 6 and the circumferential speed of the plate cylinder 1.

Figure 2:
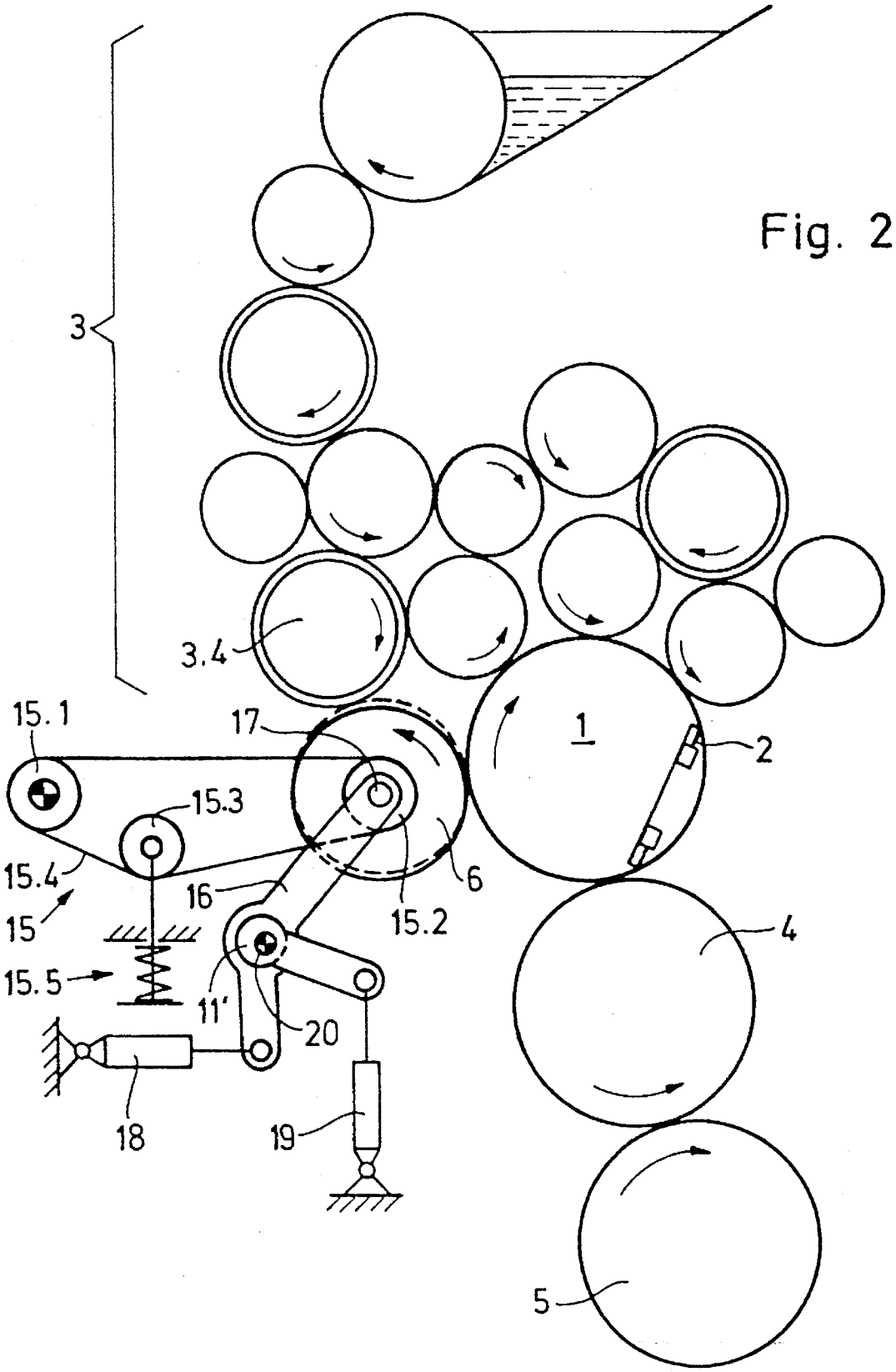
FIG. 2 is a view like that of FIG. 1 of the printing unit according to the invention having the auxiliary roller also in the first operating position thereof, and a second and different embodiment of the driving and actuating mechanism for the auxiliary roller.

The embodiment of the invention shown in FIG. 2, in comparison with the embodiment illustrated in FIG. 1, has a modified driving and actuating mechanism for the auxiliary roller 6. In this regard, a transmission device 15 is provided for driving the auxiliary roller 6. The transmission device 15 has a first transmission wheel or pulley 15.1 rotating uniformly during operation, a second transmission wheel or pulley 15.2 driving the auxiliary roller 6, an endless transmission member 15.4 looping around the two transmission pulleys 15.1 and 15.2, a tensioning wheel or pulley 15.3 for applying tension to the transmission member 15.4, and a spring arrangement 15.5 exerting pressure upon the tensioning pulley 15.3 for the purpose of tensioning the transmission member 15.4. The transmission device 15 may, in particular, be in the form of a V-or toothed-belt drive. In the embodiment of FIG. 2, the first transmission pulley 15.1 is mounted so as to be fixed locally against movement and may. for example, be driven by a non-illustrated conventional controllable motor. A double-lever device 16 carries, at respective ends of first levers thereof, a shaft 17 which rotatably holds the second transmission pulley 15.2 and the auxiliary roller 6. Respective opposite ends of second levers of the double-lever device 16 are articulatedly connected to a first actuator device or actuating mechanism 18, by means of which the double-lever device 16 is swivellable about an eccentric bushing 11' which is, in turn, swivellable by means of a second actuator device or actuating member 19 about a shaft 20 which is locally fixed.

The auxiliary roller 6 is represented in solid lines in the first operating position thereof. The movement of the auxiliary roller 6 into the second operating position thereof is accomplished by a corresponding actuation of the first actuator device 18 and, in association therewith, a swivelling of the double-lever device 16 about the eccentric bushing 11'. By means of corresponding actuation of the second actuator device 19, the auxiliary roller 6 can be moved into a third operating position thereof represented by the broken lines, wherein the auxiliary roller 6 is in contact with the printing plate 2 and also with the inking roller 3.4 and, consequently, forms a constituent part of the inking unit 3. This position of the auxiliary roller 6 is provided, within the scope of the invention, for a washing operation wherein the auxiliary roller 6, in advantageous manner, may be washed jointly with the inking unit 3 and the printing plate 2.

A releasable rotary coupling may be provided between the second transmission pulley 15.2 and the auxiliary roller 6. It is thereby possible to ensure that the auxiliary roller 6, only in the first operating position thereof, wherein it is in engagement exclusively with the printing plate 2, does the auxiliary roller 6 rotate at the circumferential speed provided in accordance with the invention which differs from the circumferential speed of the plate cylinder 1.

Figure 3:
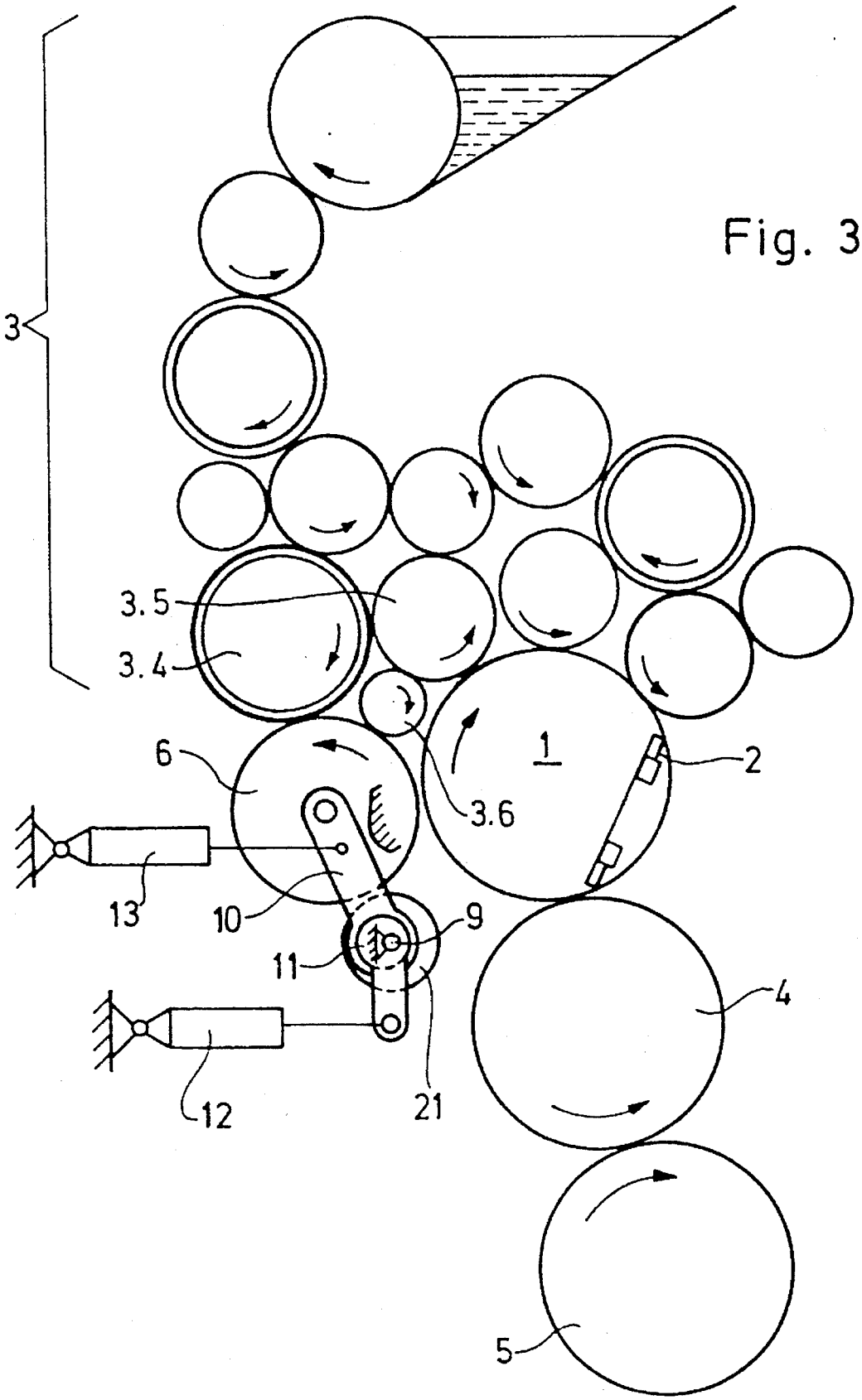
FIG. 3 is a view like those of FIGS. 1 and 2 of the printing unit according to the invention having the auxiliary roller in a second operating position thereof, an actuating mechanism like that of FIG. 1, and a different embodiment of the driving mechanism for the auxiliary roller, the auxiliary roller in the second operating position thereof being integrated into the inking unit in a manner different from that shown in FIGS. 1 and 2.

In the embodiment represented in FIG. 3, an actuator device or actuating mechanism 13 is provided which is identical with that provided with the embodiment of FIG. 1 for moving the auxiliary roller 6 into the respective operating position thereof. Diverging from the last-mentioned embodiment, however, the driving means in the embodiment of FIG. 3, instead of operating by a meshing of teeth in the first operating position of the auxiliary roller 6, as shown in FIG. 1, operates by frictional contact between the auxiliary roller 6 and a driving roller 21. As in the exemplary embodiment of FIG. 1, the driving roller 21 has a drive connection to the drive unit mentioned hereinbefore in conjunction with FIG. 1 and, during operation, executes a rotation which, through the aforementioned frictional contact, imparts a rotation with the characteristics according to the invention to the auxiliary roller 6 when the latter is in the first operating position thereof.

Particularly suitable construction for the auxiliary roller 6 is a roller with a rubber-elastic outer cylindrical surface. It is thereby possible to ensure a reliable driving of the auxiliary roller 6 due to the frictional contact thereof with the aforementioned driving roller 21. For this purpose, the driving roller 21 is preferably provided with a metallic outer cylindrical surface of such peak-to-valley height that, assuming that there is an appropriate mutual engagement between auxiliary roller 6 and driving roller 21, peaks of the peak-to-valley-height profile press into the rubber-elastic outer cylindrical surface of the auxiliary roller 6. In the embodiment shown in FIG. 3, the requisite mutual engagement may be accomplished through appropriate swivelling of the eccentric bushing 11 by means of the actuator device or actuating mechanism 12.

FIG. 3 represents the auxiliary roller 6 in the second operating position thereof wherein, through corresponding roller contact, it forms a constituent part or component of the inking unit 3. The embodiments according to FIG. 1 and 2, on the one hand, and according to FIG. 3, on the other hand, differ with regard to the manner of integration of the auxiliary roller 6 into the inking unit 3. The formation of an ink coating of predetermined film thickness on the auxiliary roller 6 in the second operating position thereof after a state of equilibrium has been reached has already been discussed in conjunction with the embodiment of FIG. 1. This applies as well, of course, with reference to the embodiment in FIG. 3, especially as the invention incorporates the idea of making-ready a doctor-blade roller provided with an ink coating for temporarily wiping the printing plate 2. The aforementioned ink coating has a different film thickness, however, depending upon the manner of temporary integration of the auxiliary roller 6 into the inking unit. In the case of an integration according to FIG. 1 and FIG. 2, respectively, the film thickness is greater than in the case of FIG. 3 because, in the first-mentioned case, the auxiliary roller 6 acts as a rider roller of the inking unit 3 whereas, in the case in FIG. 3, it is integrated into the ink flow within the inking unit 3. This integration into the ink flow is implemented in the embodiment of FIG. 3 by a simultaneous engagement of the auxiliary roller 6, in the second operating position thereof, with the inking roller 3.4 which cooperates with a plate inker 3.5, and with an intermediate roller 3.6 which cooperates likewise with the plate inker 3.5.

Consequently, the invention of the instant application, as described hereinbefore, includes different embodiments of a driving and actuating mechanism, as well as different embodiments for effecting suitable inking or ink feeding.

I claim:

1. Printing unit for a rotary offset printing press having a plate cylinder bearing a printing plate suitable for offset-printing operation free of dampening solution, and an inking unit with a multiplicity of inking rollers for inking the printing plate during operation with a printing ink suitable for offset-printing operation free of dampening solution, comprising an auxiliary roller bringable, independently of the inking rollers, into engagement with and out of engagement from the printing plate, said auxiliary roller, at least in a first operating position thereof wherein it is in engagement with the printing plate, being rotatable opposite to the direction of rotation of the plate cylinder at a circumferential speed different from the circumferential speed of the plate cylinder and, in a second operating position thereof wherein it is out of engagement with the printing plate, forming a component or constituent part of the inking unit.

2. Printing unit according to claim 1, wherein said auxiliary roller, as viewed in the direction of rotation of the plate cylinder, is disposed forward of the inking unit.

3. Printing unit according to claim 1, including a gearwheel rotating uniformly during operation, and a toothed section connected to said auxiliary roller and meshing with said gearwheel for driving said auxiliary roller.

4. Printing unit according to claim 1, including a transmission device having a first transmission pulley rotating uniformly during operation, a second transmission pulley for driving said auxiliary roller, an endless transmission member looped around said first and said second transmission pulleys, a tensioning pulley for applying tension to said transmission member, and a spring device for exerting pressure upon said tensioning pulley for tensioning said transmission member.

5. Printing unit according to claim 1, including a driving roller rotating uniformly during operation, said driving roller, at least when said auxiliary roller is in said first operating position thereof, being in engagement with said auxiliary roller for driving said auxiliary roller by means of frictional contact.

6. Printing unit according to claim 1, wherein said auxiliary roller, in a third operating position thereof, both is in contact with the printing plate and, by engagement with a roller of the inking unit, forms a constituent part or component of the inking unit.

* * * * *